US006929509B2

(12) United States Patent
Soriano

(10) Patent No.: US 6,929,509 B2
(45) Date of Patent: Aug. 16, 2005

(54) METHOD AND DEVICE FOR SEALING OFF CHANNELS OF ELECTRIC CONNECTORS

(75) Inventor: Louis Soriano, Aubagne (FR)

(73) Assignee: Komax Holding AG, Dierikon (CH)

( * ) Notice: Subject to any disclaimer, the term of this patent is extended or adjusted under 35 U.S.C. 154(b) by 26 days.

(21) Appl. No.: 10/393,145

(22) Filed: Mar. 20, 2003

(65) Prior Publication Data

US 2003/0181101 A1 Sep. 25, 2003

(30) Foreign Application Priority Data

Mar. 21, 2002 (EP) ..... 02405219

(51) Int. Cl.[7] ..... H01R 13/40
(52) U.S. Cl. ..... 439/587
(58) Field of Search ..... 439/587, 275, 439/588–589, 595, 271–274

(56) References Cited

U.S. PATENT DOCUMENTS 4,653,182 A 3/1987 Fukuda et al.
4,832,615 A * 5/1989 Thakrar et al. ..... 439/272
4,921,437 A * 5/1990 Cooper et al. ..... 439/275
5,076,806 A * 12/1991 Hotea et al. ..... 439/595
5,266,045 A * 11/1993 Yamamoto et al. ..... 439/275
5,295,865 A 3/1994 Endo et al.
5,551,892 A 9/1996 Endo et al.
6,146,058 A 11/2000 Gerst et al.
6,325,669 B1 * 12/2001 Safai ..... 439/587

FOREIGN PATENT DOCUMENTS

DE 9 303 480 4/1993
EP 1 102 366 5/2001

* cited by examiner

*Primary Examiner*—J. F. Duverne
(74) *Attorney, Agent, or Firm*—Butzel Long

(57) ABSTRACT

A method and a device for sealing off one or more channels formed in an electric connector places a plug in a channel using a plug support receiving the plug from a plug feeder, and a guide and thruster for transferring the plug from the plug support through the guide and into the channel. The guide and the connector can have conforming adjacent faces. The plug support can have multiple orifices for transferring a first set of plugs to a connector while being loaded with a second set of plugs for transfer to another connector.

17 Claims, 12 Drawing Sheets

FIG.1
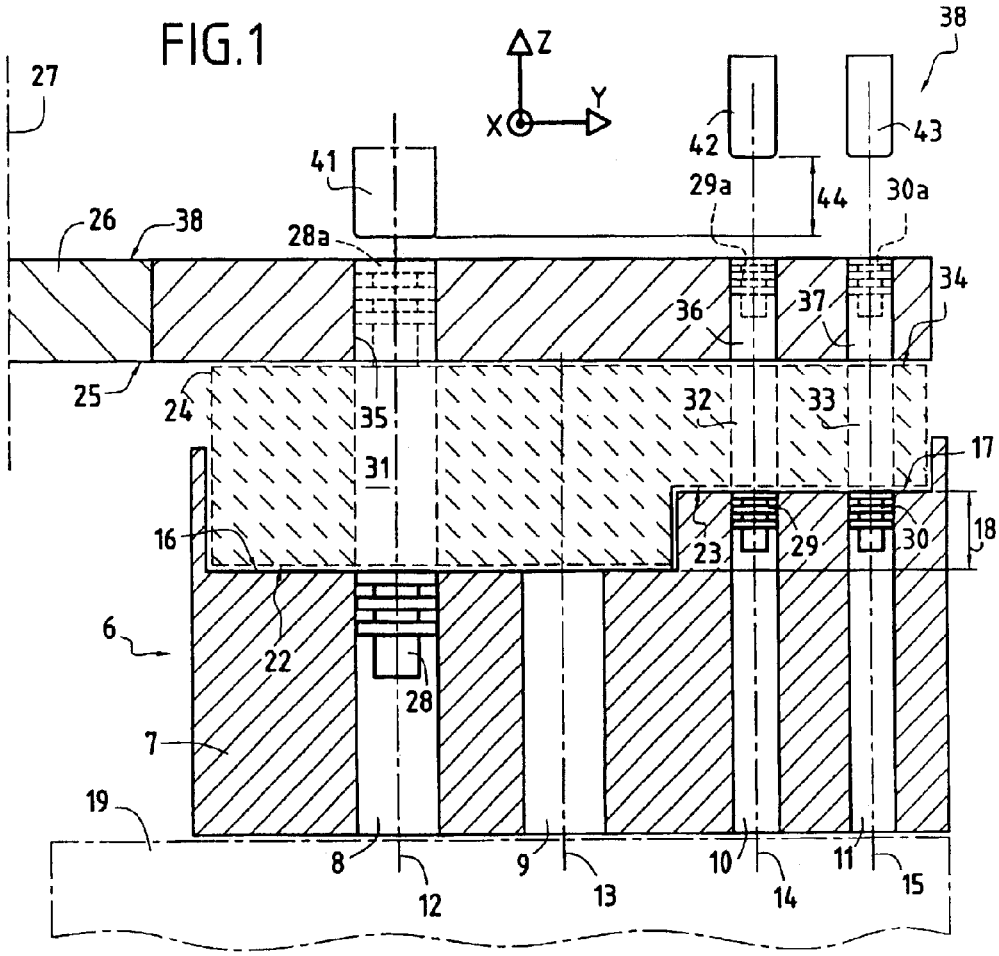
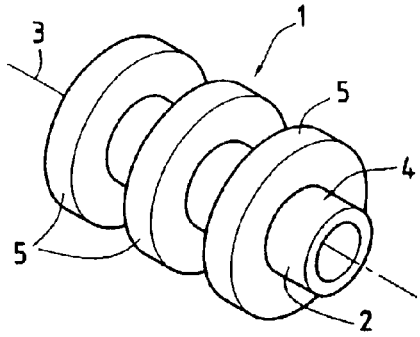
FIG.2

71
27
39
69
70
58
64
57
54
43
42
41
17
68
63
55
25
26
24
65
23
16
6
20
22
66
21
19
Z
Y
X

METHOD AND DEVICE FOR SEALING OFF CHANNELS OF ELECTRIC CONNECTORS

BACKGROUND OF THE INVENTION

The present invention relates to a method and a device for sealing off one or more channels formed in an electric connector.

A large number of applications require the use of electric connectors impervious to water, oil or dust, this in particular being the case of connectors used in the construction of motor vehicles or aircraft.

The U.S. Pat. No. 6,325,669 describes a sealed connector that has a body traversed by several parallel channels of various diameters. Each of these channels is designed to receive a bracket equipping the extremity of a wire section, this extremity being equipped with an elastomer joint to ensure imperviousness between the wire and the channel receiving the wire.

The U.S. Pat. No. 5,295,865 describes a joint for a sealed connector including: i) a tubular portion able to be rendered integral with a metal bracket; ii) a sealing portion ensuring a sealed contact with a housing receiving the joint; iii) a reinforcement for the sealing portion; and iv) a sliding contact member facilitating the movement of the joint inside a joint feeder device. The joint is adapted for feeding an automatic machine for producing electric beams incorporating sealed connectors.

The U.S. Pat. No. 6,146,058 and the European patent application EP 1 102 366 describe joint transport and sorting devices for feeding a machine for automatically producing these electric beams. The device described in the '058 patent includes a vibrating support having a profile groove adapted to the shape of the joints and which feeds a joint insertion unit on wire section extremities. The device further includes a sorting unit for feeding with joints the vibrating support which has an upper chamber for storing the joints in bulk, an orifice permitting the falling of joints from the upper chamber to one extremity of the vibrating support, a lower chamber for recovering the joints and a pneumatic pipe for transporting the joints from the lower chamber to the upper chamber. The European document describes a device for ejecting the joints incorrectly placed in a row of joints transported by a joint feeding device of an insertion station.

For reasons of economy and production management, it is often the case to use only one portion of the channels of a sealed connector to receive wire section extremities. In this case, so as to ensure imperviousness of the connector, as shown in FIG. 1, the connector channels not receiving a wire section are sealed by a plug, such as the one shown in FIG. 2.

These plugs resemble the joints inserted at the extremity of a wire section. However, they differ from these by the fact that they are not traversed by a wire duct so as to ensure sealing off of the unused channel of the sealed connector. This plug generally appears in the form of a silicon molded element having a symmetry of revolution. FIG. 2 shows a cylindrical plug provided with three annular projections.

When being handled, these plugs are delicate owing to their small size (dimensions of about several millimeters), their light weight, their extensive warping capacity under low stresses, the presence of projections and the low coefficient of friction of the material constituting said plugs.

To the knowledge of the inventor, there currently exists no device for automatically placing these plugs in the unused channels of the electric connector. These plugs are inserted one by one by a human operator without the insertion depth and/or quality of the plug in the channel of the connector being inspected and controlled.

SUMMARY OF THE INVENTION

An object of the method and device according to the present invention is to resolve this lack of any available device and offer a method and device for automatically inserting these plugs in channels of an electric connector.

According to a first characteristic, the present invention concerns a device for placing one or more plugs in a channel or several channels of a sealed connector and which includes: at least one connector support, at least one plug support able to receive one or several plugs adapted to said channel or channels, means for feeding with plugs the first plug support, and means for transferring one or several plugs from the first plug support to said channel or channels of the connector.

According to another characteristic, the present invention concerns a machine for inserting one or more sealing plugs in one or more housings of a connector, said connector having at least one face on which said housing(s) open(s), said face having at least a particular shape, the machine including thrust means so as to push the plug(s) in order to introduce it/them into the housing(s), as well as guide means for guiding the plug(s) when it/they move under the action of thrust means, said guide means having a face having a shape conforming, at least in part, to the shape of the face of the connector.

According to another characteristic, the present invention concerns a unit for inserting seals in the alveoli of an electric connector, said unit including: a unit for feeding seals in rows from a bulk seals container; a first seal insertion unit for inserting the seals delivered by the feed unit in the alveoli of a mobile seal transfer support; seal transfer means for moving the seal transfer mobile support between a seal loading position on the mobile transfer support and a seal unloading position; a second seal insertion unit able to unload the seals from the mobile seal transfer support and to push the seals through seal guide means and as far as into the alveoli of the connector; and an electronic control unit able to control the functioning of the seal feed unit, first and second seal insertion units, as well as seal transfer means according in particular to the data recorded in a data memory cooperating with or incorporated with the electronic control unit.

According to another characteristic, the present invention concerns a method for introducing a plug in the channels of a connector placed on a connector support, the plugs being contained in bulk in a container, said method including the following operations in succession: extracting the plugs from the container and placing them in a row; transferring at least one plug from the row of plugs to a mobile plug transfer support; moving the mobile plug transfer support so as to place at least one plug in the alignment of at least one channel to be sealed from the connector; inserting an insertion guide between the mobile plug transfer support and the connector; and extracting at least said first plug from the mobile plug transfer support and inserting this plug in the channel of the connector by guiding it by means of the insertion guide.

The device and method according to the present invention make it possible to insert sealing plugs in the channels—housings or alveoli—of an electric connector by simple, precise, reliable and repetitive means.

The devices of the present invention are compact, simple to use and it is also easy to program in their functioning.

By adapting the shape of the plug transfer and guide means to those of the plugs and of the connector, it is possible to use the device of the present invention for different types of connectors and plugs without incurring additional expense.

The device according to the present invention is able to embody an insertion of plugs at a production rate reaching and exceeding 1,000 to 10,000 plugs an hour.

The device according to the present invention is fully adapted to the automatic insertion of plugs in alveoli extremely close to one another and distributed diversely on one or several faces of a connector immediately close to projections likely to impede this insertion.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a cross-sectional view of a connector having four insertion channels, three of which are sealed off by plugs, and partially shows a rotary plug transfer disk and an insertion guide inserted between the disk and the connector and coupled to the latter according to the present invention;

FIG. 2 is a perspective view of a ribbed plug;

FIGS. 7 and 8 are schematic elevation views, respectively front and side, of a second alternate embodiment of a device according to the present invention wherein FIG. 7 is a view in a direction of an arrow VII in FIG. 8.

DESCRIPTION OF THE PREFERRED EMBODIMENT

Figure 3:
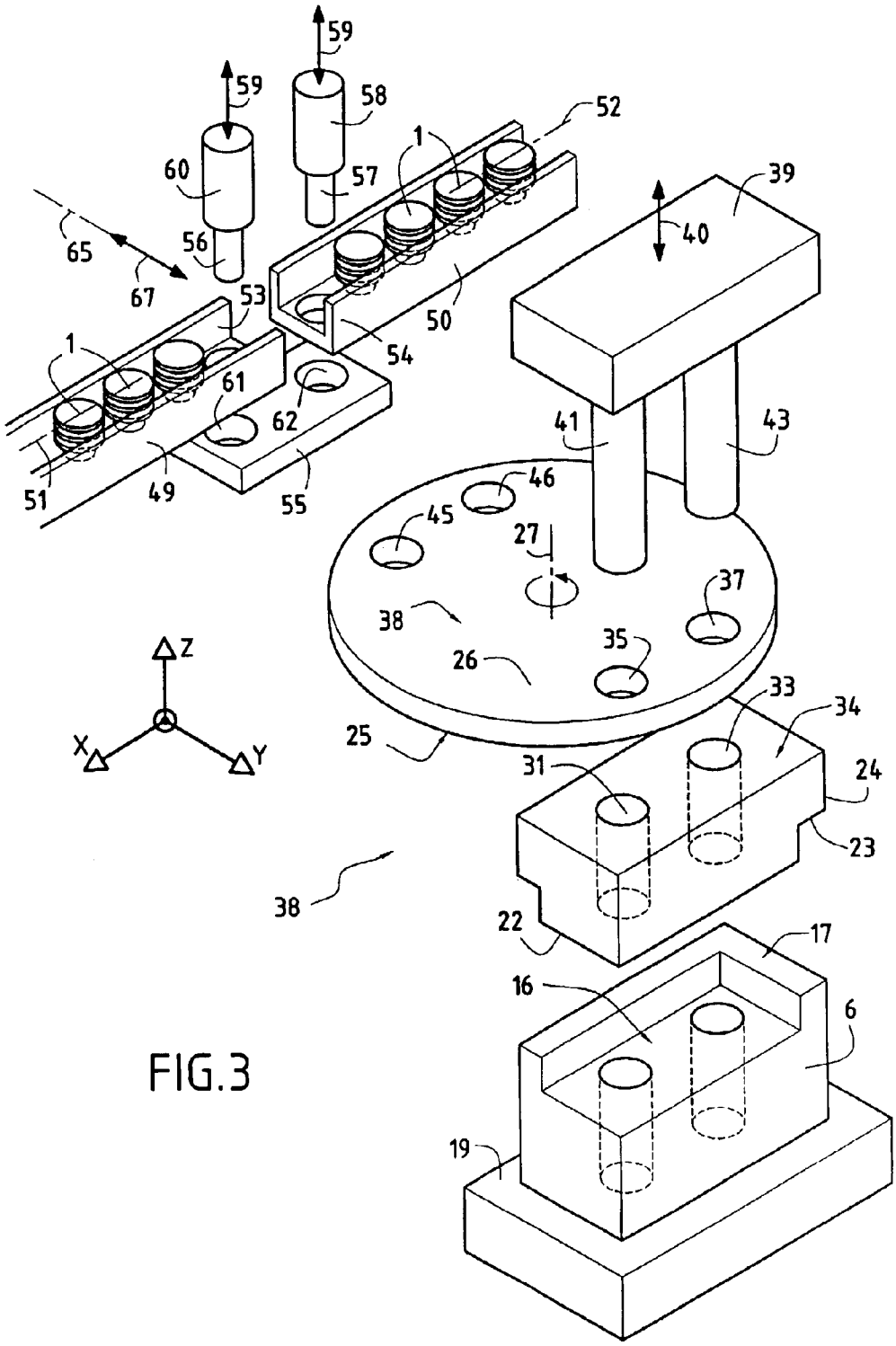
FIG. 3 is an exploded perspective view showing the main components of a device according to the present invention and its use in a method according to the present invention.

With reference to FIG. 2, a plug 1 has a cylindrical core 2 with a longitudinal axis 3 and three ductile annular ribs 5 projecting from an external surface 4 of the core.

With reference to FIG. 1, a connector 6 has a body 7 pierced with four cylindrical channels 8 through 11 whose respective axes 12 through 15 are parallel to one another. The channels 8 and 9 are wider and open onto a first face 16 of the body 7, whereas the channels 10 and 11 are narrower and open onto a second face 17 of the body 7. The faces 16 and 17 are situated at an upper portion of the connector 6, are orthogonal to the axes 12 through 15 and are spaced vertically apart by a distance 18.

Figure 5A:
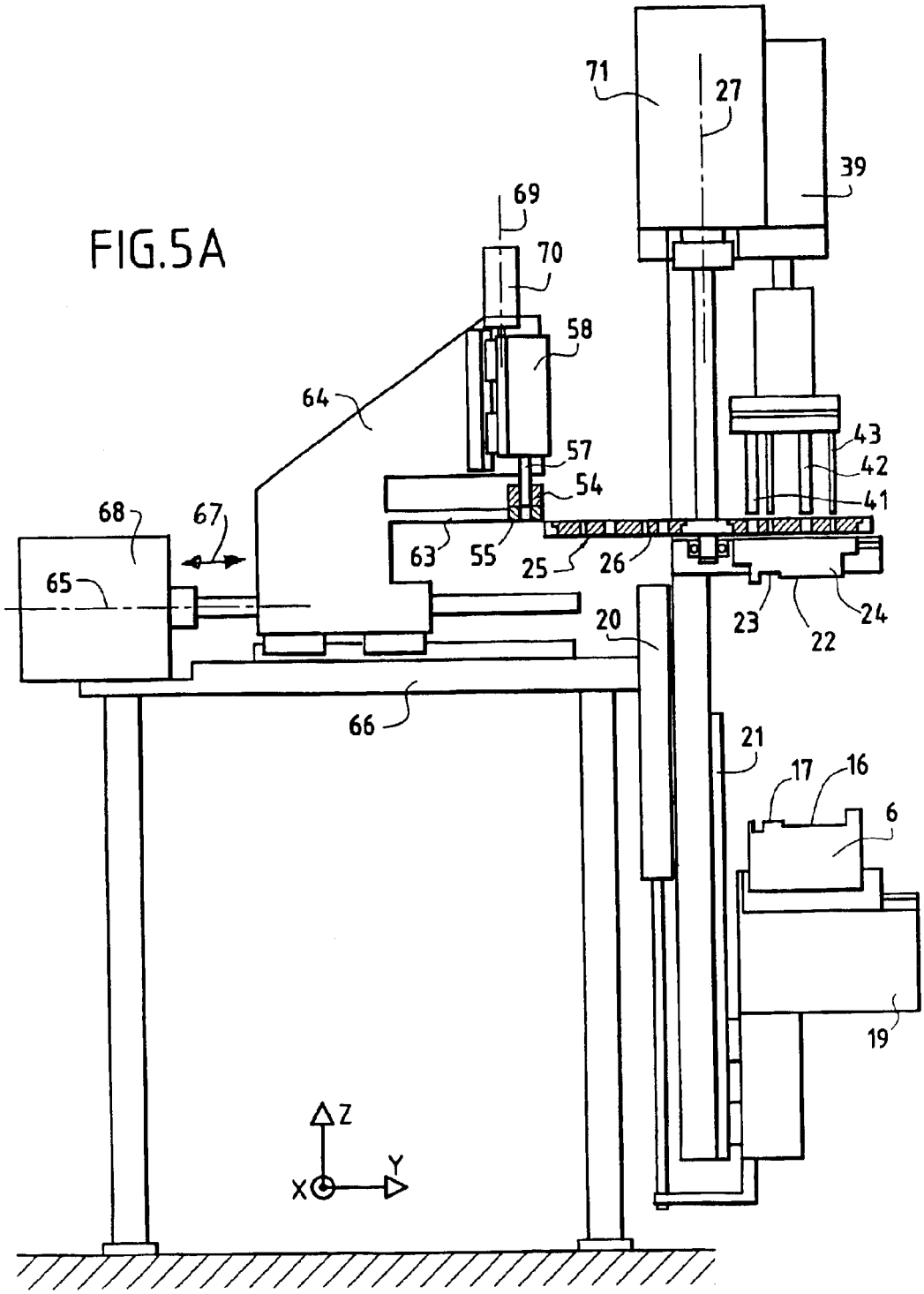
FIGS. 5A through 5G are schematic side elevation views of a first embodiment of a device according to the present invention and which incorporates the components shown in FIGS. 3, 4A and 4B and showing successive positions of these components corresponding to stages of a method according to the present invention.

The connector 6 rests on a support 19 mounted mobile in translation along a generally vertical axis Z (shown in all figures except FIG. 2) under the action of a thruster or actuator 20 along a fixed guide structure 21 as shown in FIG. 5A.

Figure 5B:
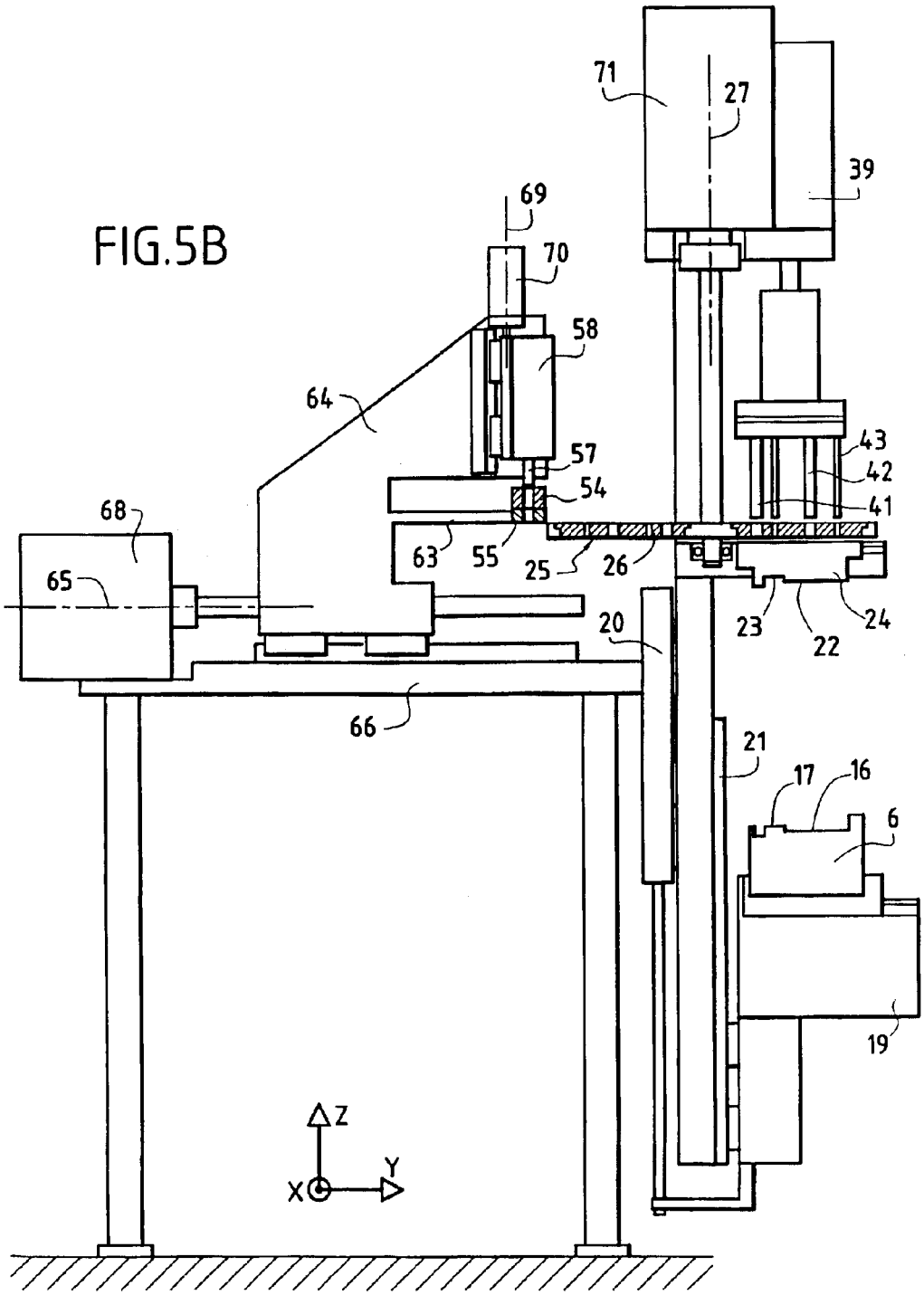
Figure 5C:
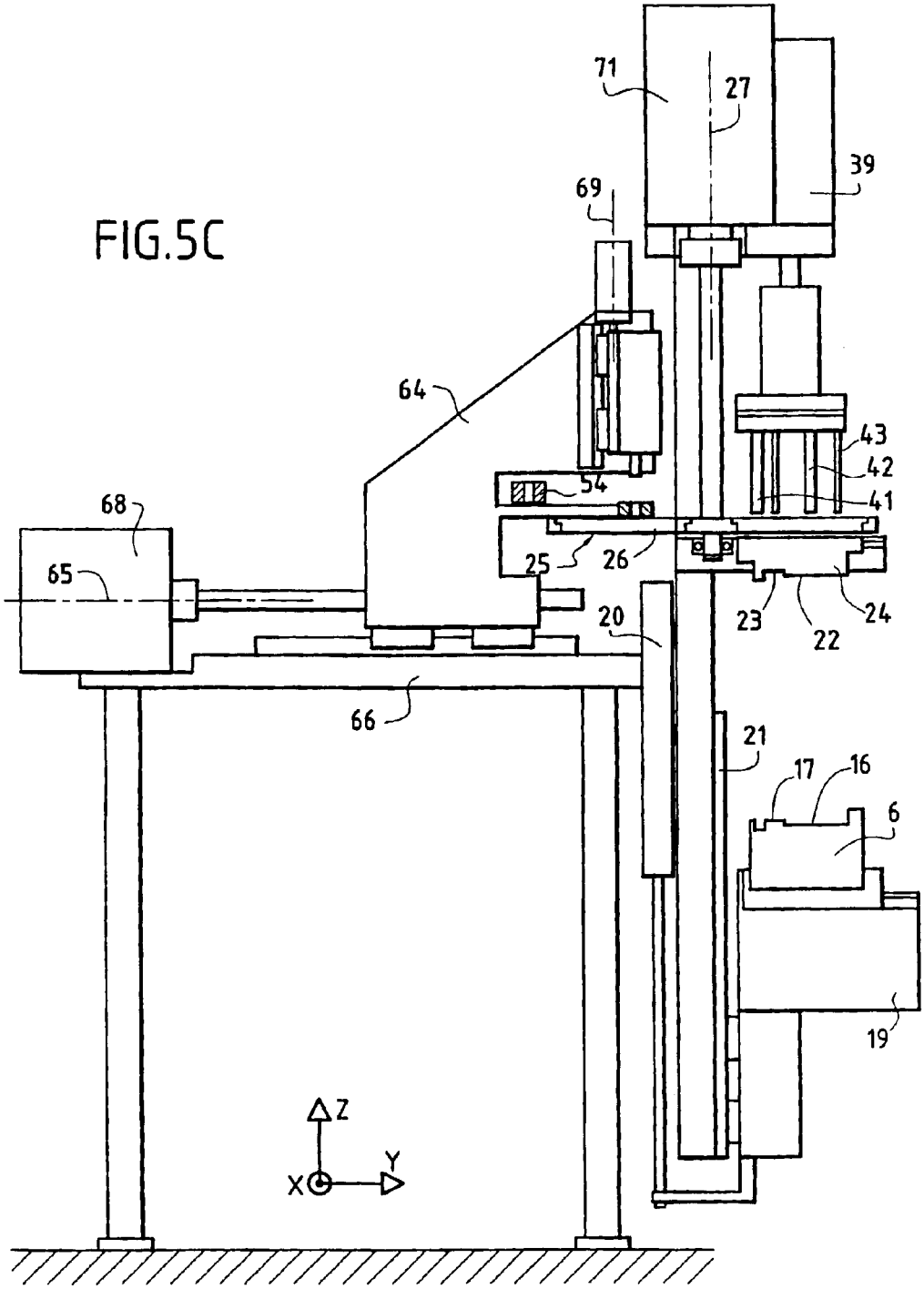
Figure 5D:
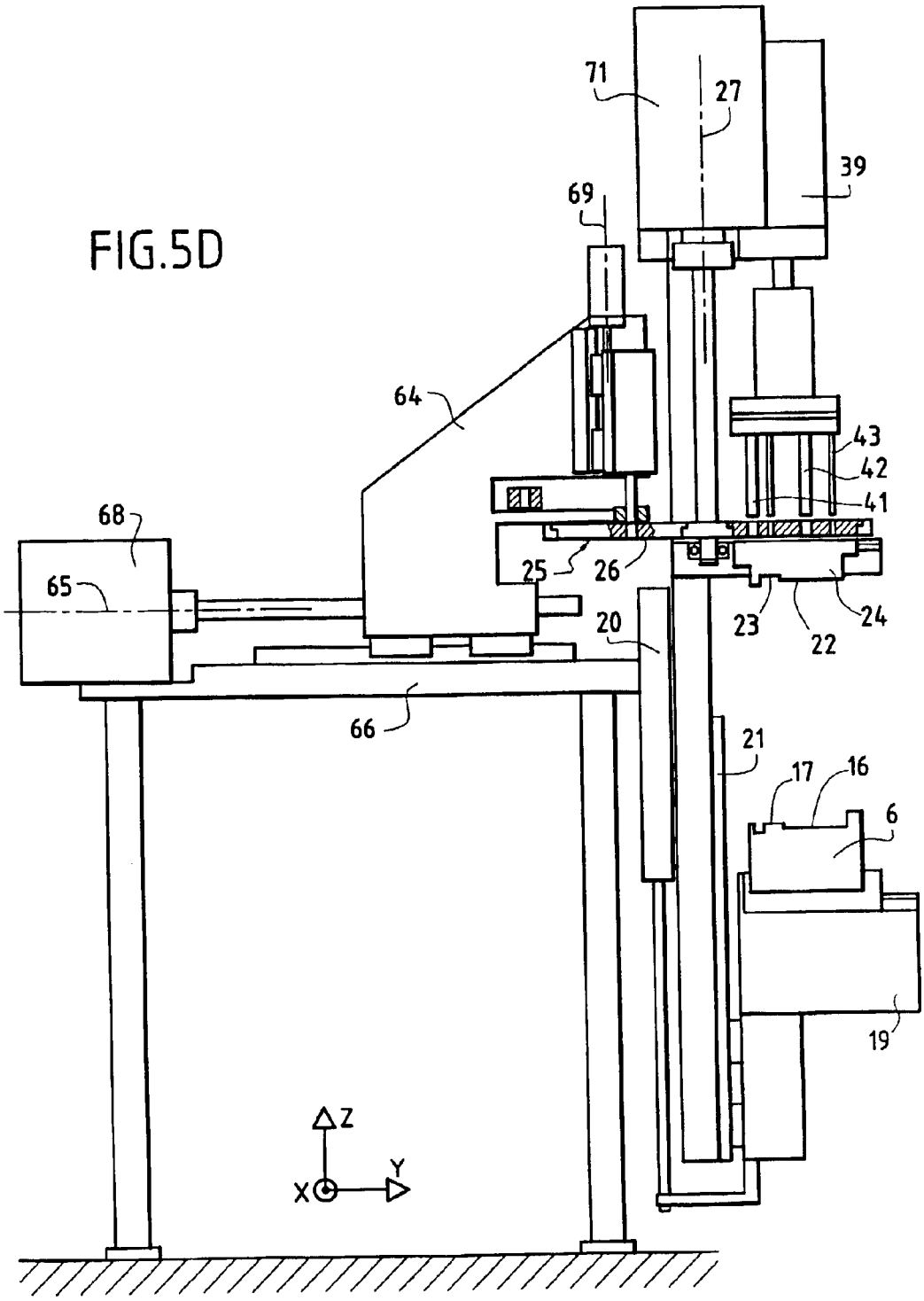
Figure 5E:
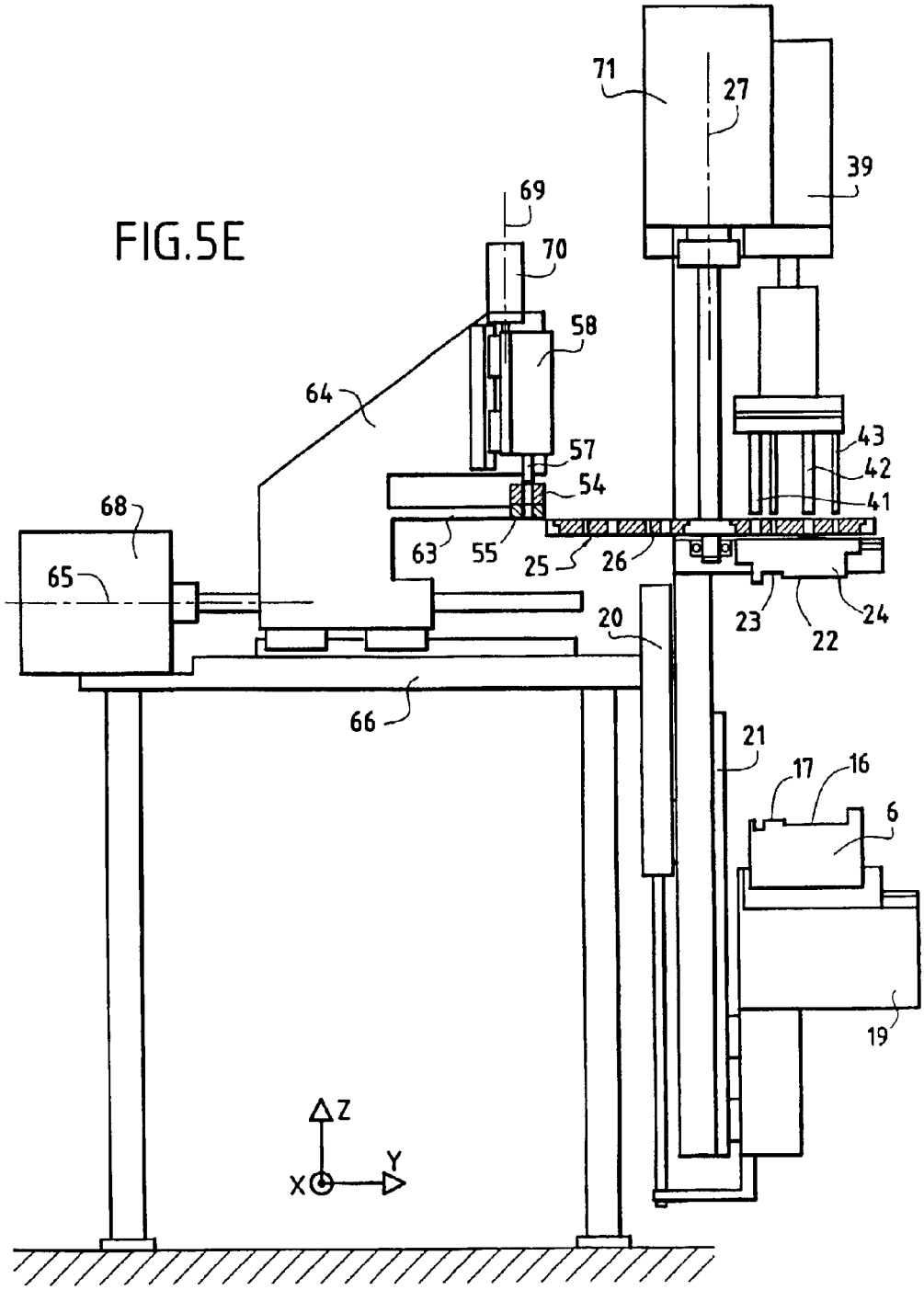
Figure 5F:
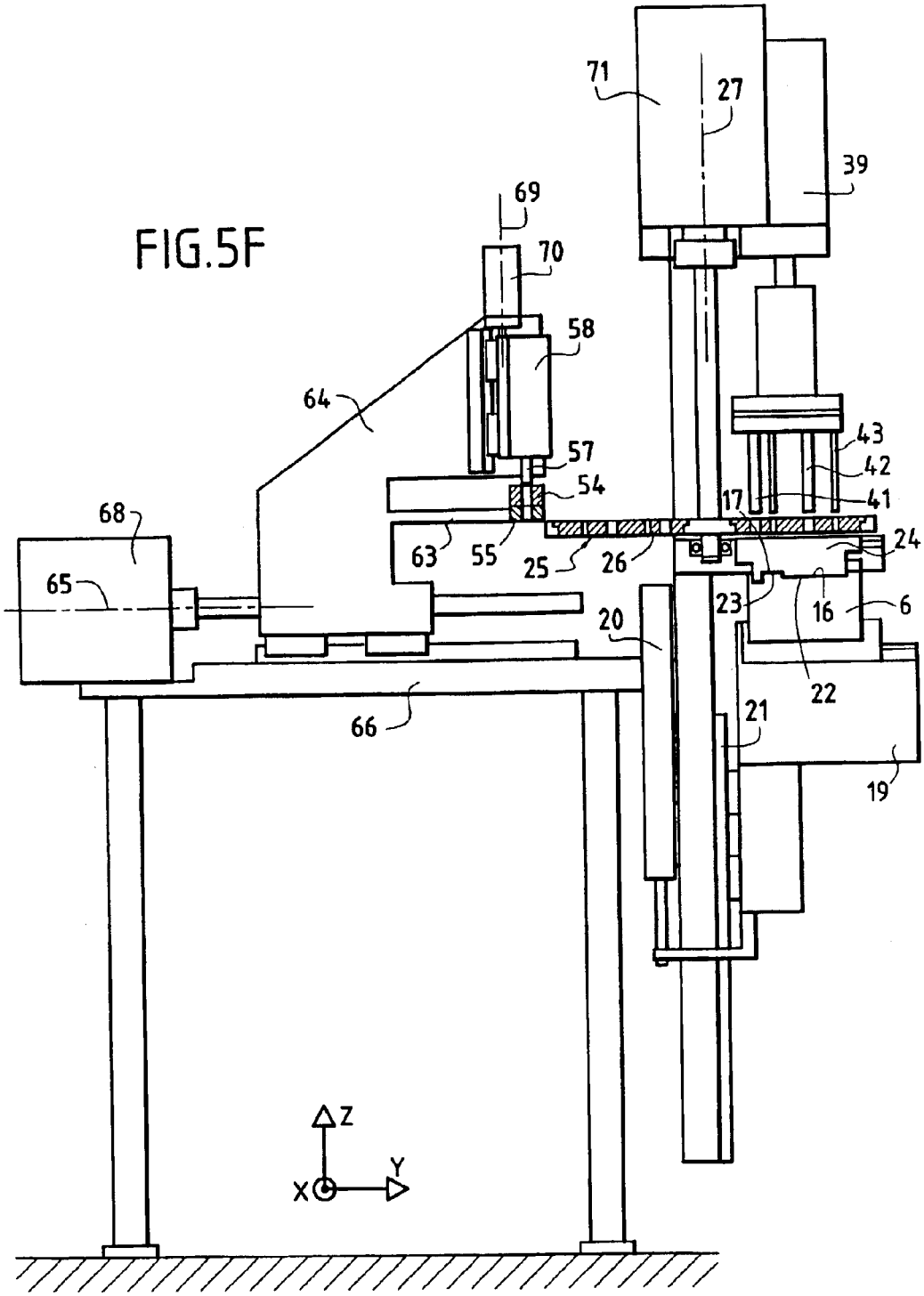

FIGS. 1 and 5F show in particular the faces 16 and 17 of the connector 6 that conform to respectively lower external faces 22 and 23 of a guide element 24 mounted fixed under a lower face 25 of a plug transfer disk 26 mounted rotating about a vertical axis 27.

The element 24 is used to guide plugs 28 through 30 during the time they are transferred from the disk 26 into the channels 8, 10 and 11 respectively of the connector 6. To this effect, the element 24 is pierced with three parallel cylindrical channels 31 through 33 whose spacing (and position inside a plane X-Y) is identical to that of the channels 8, 10 and 11 respectively and which traverse right through the element 24 and firstly open on an upper face 34 thereof and secondly on one of the lower faces 22 and 23. As a result, when, as shown in FIG. 1, the element 24 is nested on the upper face of the connector 6, the channels 31 through 33 are aligned with and extend the channels 8, 10 and 11 respectively.

Similarly, the disk 26 is pierced with three cylindrical channels or orifices 35 through 37 which open onto each of the lower face 25 and an upper face 38 of the disk 26 and whose position inside the plane X-Y is identical to that of the channels 31 through 33 respectively (and to that of the channels 8, 10 and 11 respectively). The diameter (and/or the transversal dimensions) of the channels 31 through 33 and 35 through 37 is selected to be slightly smaller than the diameter of the plug to be received in the channel in question so that the plug can be easily housed there by virtue of the deformation of its ribs 5 (FIG. 2), be kept there by friction forces exerted between these ribs and the internal face of the wall delimiting the channel whilst being able to slide along the longitudinal axis of the channel under the action of a thruster or actuator. To this effect, the device according to the present invention includes a thruster or actuator 39 (FIG. 3) mounted mobile in vertical translation 40 (FIG. 3) equipped with three cylindrical fingers 41 through 43 extending downwardly parallel to the vertical axis Z. The configuration (position inside the plane X-Y) of the fingers 41 through 43 is identical to that of the channels 8, 10 and 11 respectively, the channels 31 through 33 respectively, and the channels 35 through 37 respectively. The diameter (or transversal dimension) of the fingers 41 through 43 is selected so as to enable them to slide friction-free in the channels of the disk 26 and of the guide element 24, and also in the channels of the connector 6.

The functioning of this plug insertion device inside the channels of the connector 6 is as follows: three plugs 28*a*, 29*a* and 30*a* required to seal off the three channels 8, 10 and 11 are respectively placed inside the orifices 35 through 37 of the disk 26 by means described hereafter. The disk 26 bearing the plugs is orientated—via rotation about the axis 27—so that the plugs 28*a* through 30*a* and the channels of the disk receiving them are respectively aligned with the fingers 41 through 43 which themselves are aligned with the channels 31 through 33 of the guide 24. These guide channels are aligned with the channels 8, 10 and 11 of the connector 6 along their respective axes 12, 14 and 15 via the mutual nesting of the guide 24 and the connector 6.

The guide 24 is preferably mounted fixed on a frame of the device according to the present invention, whereas the connector support 19 and the thrust member 39 (FIG. 3) are mounted mobile in translation along a vertical axis, after the connector 6 is moved by its mobile support 19 so as to be nested under the guide 24. The disk 26 is kept orientated as indicated previously, and the insertion of the plugs is obtained via a descending vertical movement of the device 39 with the fingers 41 through 43. The lower extremities of the fingers come to rest on the upper extremities of the plugs and an additional movement downwards of these fingers provokes the passage of the plugs from the orifices 35 through 37 of the disk to the channels 31 through 33 of the guide and then from the latter to the channels 8, 10 and 11 of the connector 6. So that the driving-in depth of the plugs into the channels 8, 10 and 11 is identical, a distance 44 separating the lower extremity of the finger 41 from the lower extremities of the fingers 42 and 43 merely needs to be identical to the distance 18 (these distances being measured along the axis Z).

The principles of feeding of the disk 26 with the plugs for transferring by the thruster 39 through the guide element 24 described previously are shown in FIG. 3 and in more detail in FIGS. 4A through 5C.

So as to improve the clarity of FIG. 3, only two unused channels of the connector 6 have been shown. As a result, the guide 24 is shown with the corresponding two channels 31 and 33 and the thruster 39 is shown with the corresponding two fingers 41 and 43.

The transfer disk 26 has the first pair of orifices 35 and 37, as well as a second pair of orifices 45 and 46 which are diametrically opposite the orifices 35 and 37 and have the same shape. Accordingly, they are placed inside the plane X-Y according to a (relative) configuration identical to that of the orifices 35 and 37 and to that of the channels of the guide and the connector.

Figure 4A:
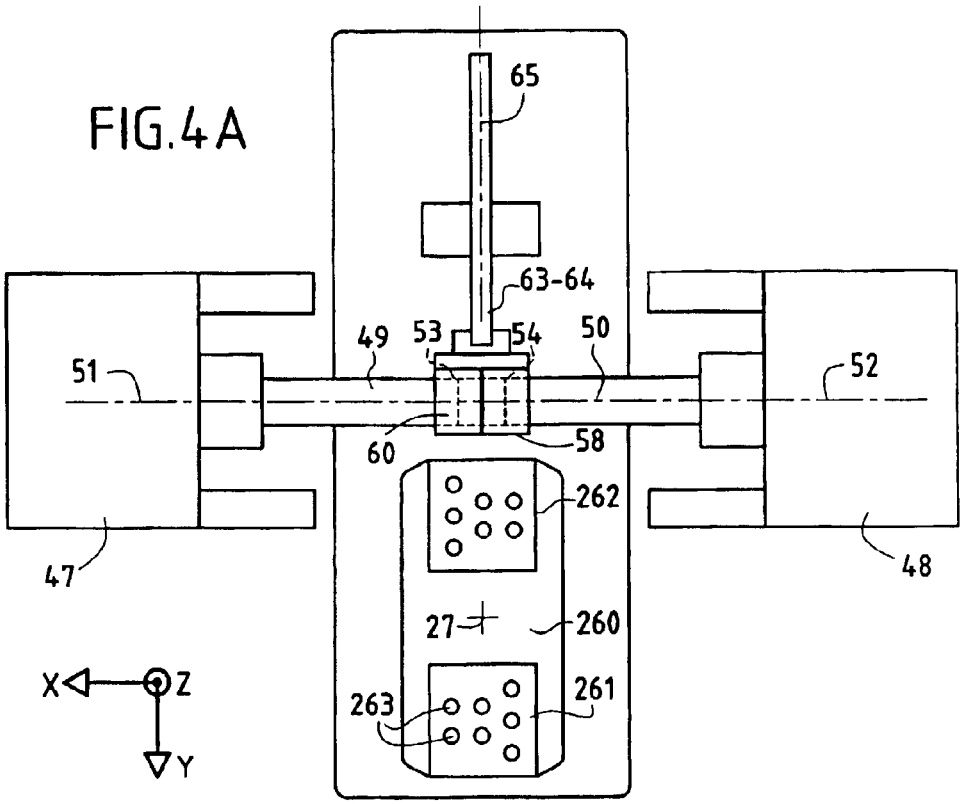
FIGS. 4A and 4B are schematic front elevation views illustrating two row plug feeding units, a double plug rotary support for transferring them to an insertion and guide station (not shown), as well as mobile means for inserting plugs delivered by the feed means in an intermediate plug transfer support (On FIG. 4A, these mobile insertion means are placed opposite the extremities of the respective feed channels of the feed units so as to allow the transfer of plugs from these channels to a mobile small plate used as an intermediate plug support, whereas on FIG. 4B, the insertion unit and this small plate are situated opposite the rotary plug transfer support so as to enable the plugs supported by the small plate to be loaded onto this rotary support.)
Figure 4B:
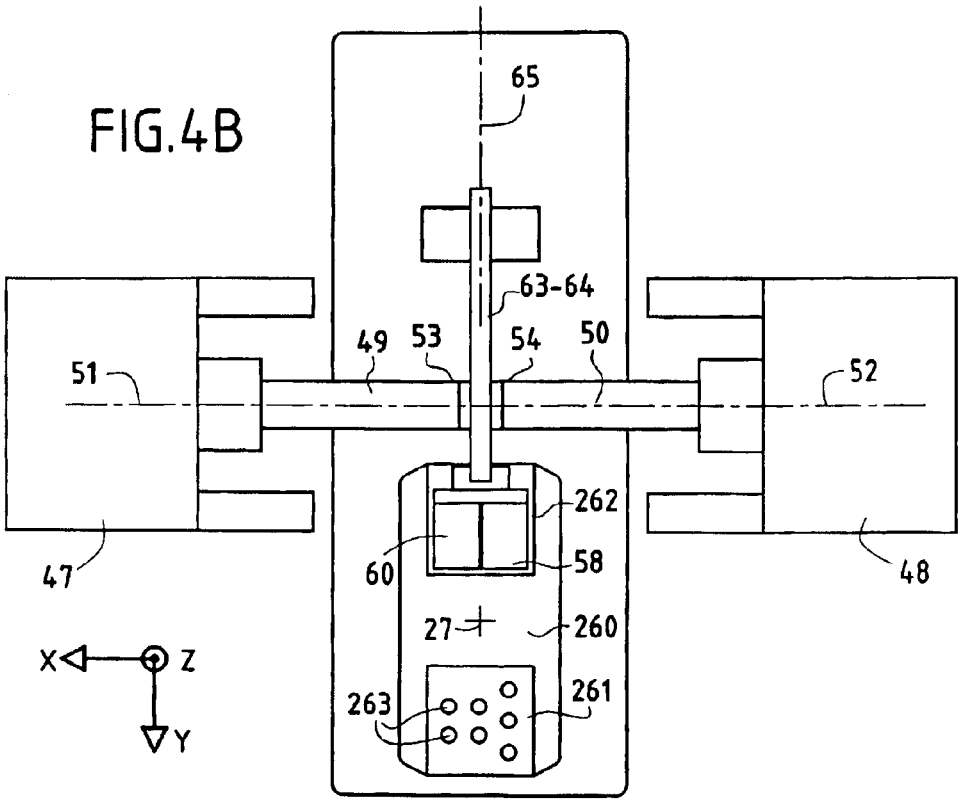

In an alternate embodiment shown in FIGS. 4A and 4B, the transfer disk 26 is replaced by an approximately rectangular plate 260 which fulfils the same function and is mounted rotating along the axis 27 parallel to the axis Z.

The plate 260 is formed of two identical plate elements 261 and 262 that are fixed movably to the plate. Each element 261 and 262 has seven perforations 263 that traverse the element and form temporary housings for the plugs carrying out the same function as the channels 35 through 37 of the disk 26 (FIGS. 1 and 3). The dimensions of each of the perforations 263 and their position are respectively adapted to the dimensions and position of the channels to be sealed off of a specific connector. The adaptation of the device to a specific connector is obtained by placing an insertion guide (24 in FIGS. 1 and 3) and the two plate elements 261 and 262 each having configuration channels adapted to this specific connector.

The use of this support 26 or 260 for transferring the plugs makes it possible to simultaneously insert a first set of plugs in a first connector and load onto this support a second set of plugs intended for a second connector identical to the first connector. This makes it possible to reduce the period of a cycle for inserting plugs in a connector.

The device for loading the (disk 26 or plate 260) mobile plug transfer support with plugs includes the following elements: the plugs 1 are stored in bulk in two containers 47 and 48 and are respectively delivered to two linear conveyors 49 and 50 extending along two merged horizontal axes 51 and 52 parallel to the axis X. The plugs 1 are delivered in a row to one extremity 53 and 54 of the feed units 49 and 50, respectively as shown in FIG. 3. This unit including the containers 47 and 48 and the conveyors 49 and 50 is preferably similar to those described in the above-mentioned documents: U.S. Pat. No. 6,146,058 and European patent document EP 1 102 366.

A horizontal small plate 55 pierced with two orifices 61 and 62 adapted to each receive a plug respectively delivered to the extremities 53 and 54 of the conveyors 49 and 50, extends under the extremities 53 and 54. The transfer of a plug from the conveyor to the small plate is obtained via a thrust directed downwards exerted on the plug by a corresponding one of fingers 56 and 57 moved in a direction of arrows 59 by a respective one of activating elements 58 and 60 until the plug is introduced in the corresponding orifice of the small plate 55.

As shown on FIGS. 5A to 5F, the small transfer plate 55 is fixed to the extremity of an arm 63 integral with a structure 64. The structure 64 is mounted mobile in translation along a horizontal axis 65 with respect to a fixed frame 66 of the device. A movement (indicated by an arrow 67) of the structure 64 along this axis is effected by an activating element 68. This movement 67 provokes an identical movement of the small plate 55 and the members 56, 57, 58 and 60 for loading plugs on the small plate, said members being mounted mobile along a vertical axis 69 on the structure 64 under the action of a translator 70.

The arm 63 supports the insert 55 at an intermediate height between that of the extremities 53 and 54 of the conveyors 49 and 50 and that of the disk 26.

The movement of the structure 64 along the axis 65 enables the small plate 55 to move from a first position shown in FIG. 4A, in which the orifices 61 and 62 of the small plate opposite the extremities 53 and 54 of the conveyors 49 and 50 to allow the insertion of plugs in the housings of the small plate by means of the thrust members 56 and 57, up to a second position, shown in FIG. 4B in which at least one of the orifices 61 and 62 of the small plate is aligned with one of the orifices (45 and 46 in the plate 26 and 263 pierced in the plate 260) to permit the transfer of the plugs borne by the small plate 55 to the support 26 or 260 via the action of the fingers 56 and 57 of the mobile insertion unit.

FIG. 5A shows the components of a device according to the present invention in a position prior to loading of the plugs on the small plate 55. This loading is shown in FIG. 5B where the finger 57 moved by the activating device 58 pushes the plug downwards into the pierced orifice in this small plate. After the finger 57 moves back up, the activating device 68 moves the structure 64 supporting the activating elements 58 and 70 and the small plate 55 to the position shown in FIG. 5C where at least one channel of the small plate 55 is aligned vertically (superimposed) with at least one channel of the disk 26. In this position, the lowering of the finger 57 and of the activating element 58 (moved by the activating element 70) causes the loading of plug on the disk, as shown in FIG. 5D.

In parallel with these operations, it is possible to insert other plugs in the disk 26 into the connector 6. The connector 6 moves from its initial lower position shown in FIG. 5E to an approach position under the guide 24 as shown on FIG. 5F. In this position, the fingers 41 through 43, moved by the activating element 39, push the plugs from the disk 26 to the connector 6 by passing through the guide 24.

Figure 5G:
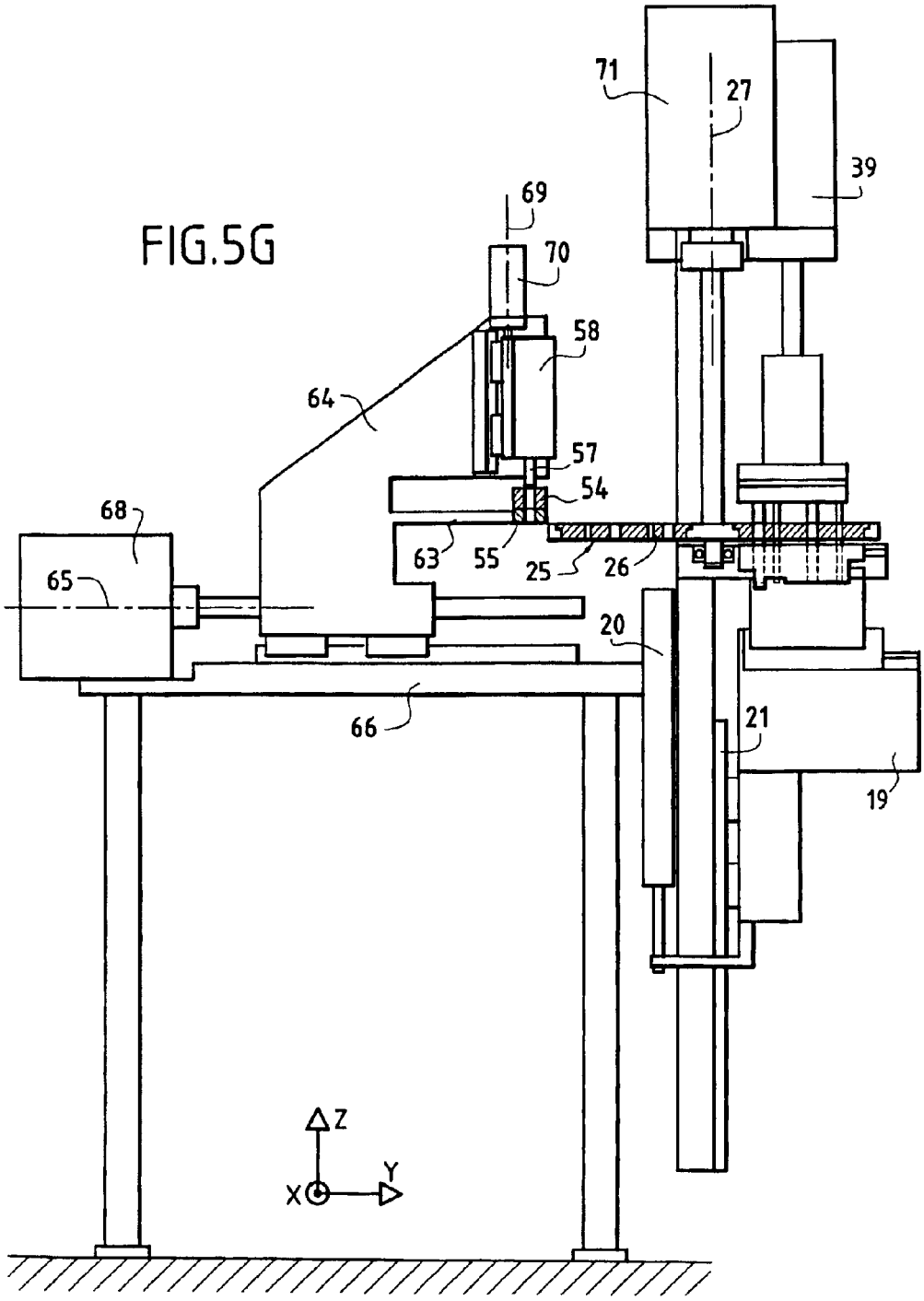

At least one portion of the operations shown in FIGS. 5A through 5D for loading plugs on the support 26 or 260 by the insertion and transfer unit 55 through 60 can be carried out simultaneously with the insertion shown in FIGS. 5E through 5G of plugs borne by the support 26 or 260 in the unused channels of the connector 6. Another portion of the loading operations of the support 26 or 260 and/or the rotation of this support along the axis 27 (under the action of an activating element 71 shown in FIGS. 5A through 5F) can be carried out during removal of the connector previously equipped with plugs by this device, during placing on the mobile support 19 of another connector to be equipped with plugs and during the movements of the connector support 19 so as to have the latter approach under the guide 24.

Figure 6:
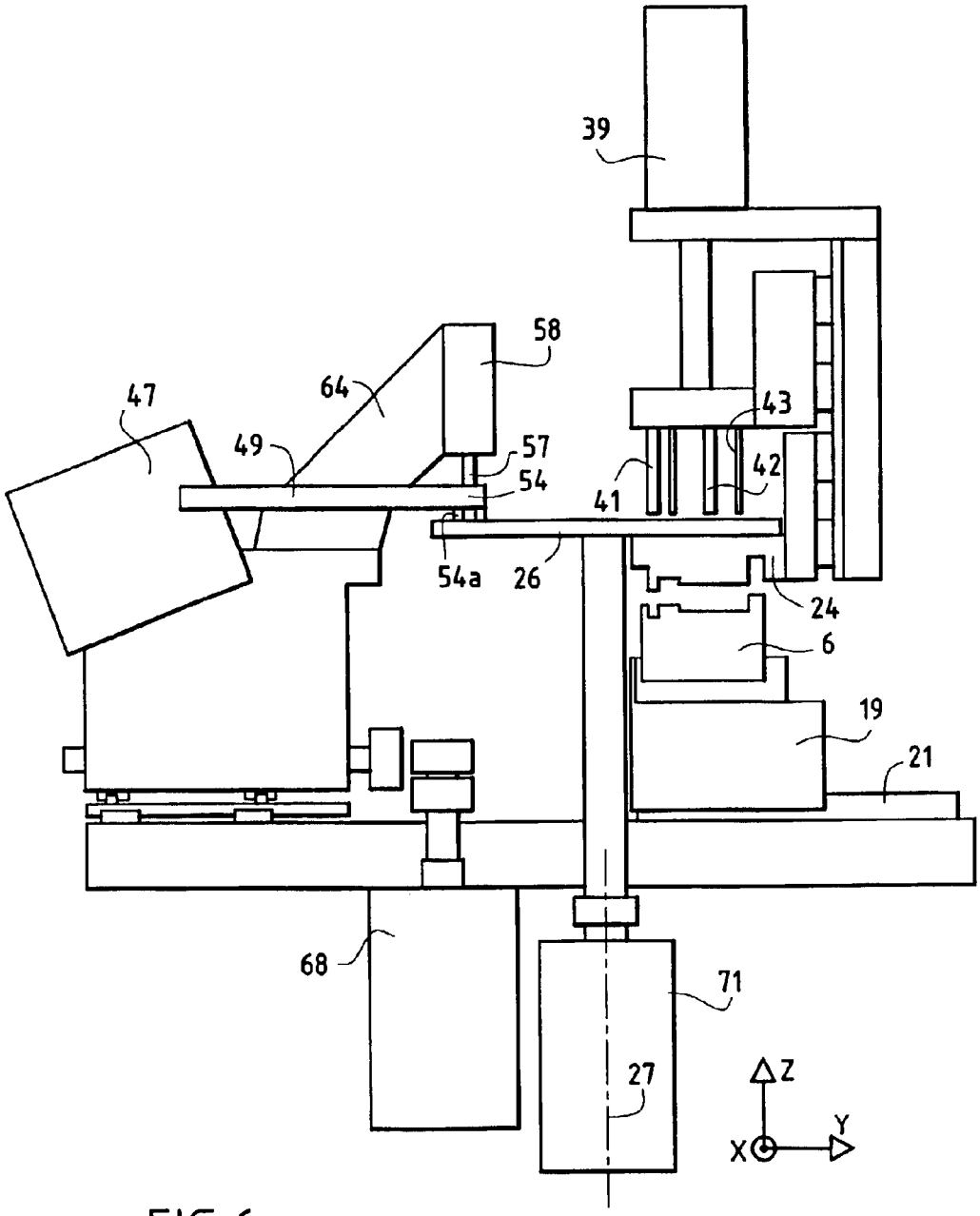
FIG. 6 is a schematic side elevation view illustrating an alternate embodiment of a device according to the present invention.
Figure 8:
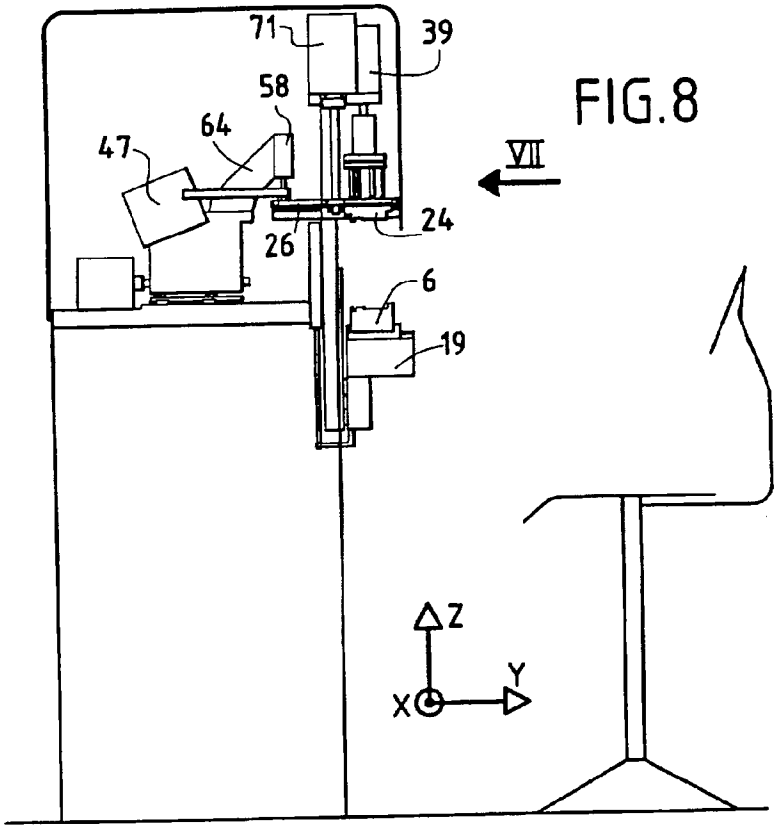
Figure 7:
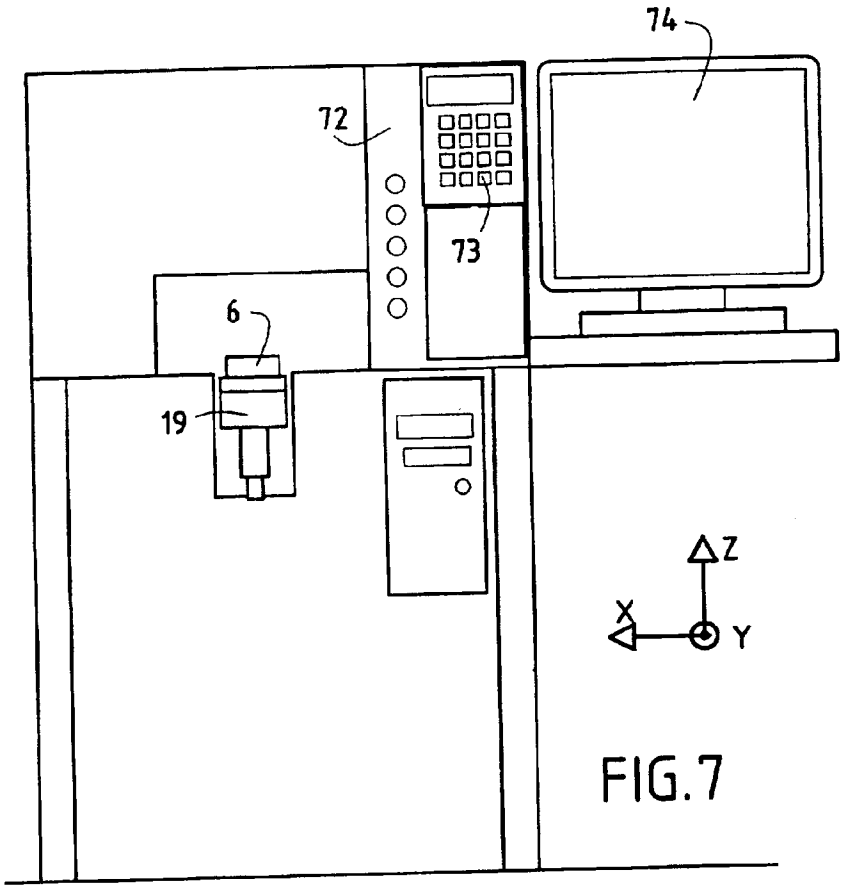

In the embodiment variants shown in FIGS. 6 through 8, a single plug feed unit 47 is provided. In these variants, the use of a second mobile transfer support, such as the small plate 55, is generally not effective. In this case, a lower portion 54*a* of the extremity 54 of the feed conveyor 49 is used to guide the plugs at the time they are loaded onto the disk 26 by the finger 57 of the insertion unit 58. In the configuration shown in FIGS. 6 and 8, the feed unit 47 and 49 is fixed to the structure 64 and moves with the latter under the action of the motor 68.

As shown in these figures, the position of the activating elements 68 and 71 can vary with respect to the positions shown in FIGS. 3 and 5A through 5C. The translation displacement axis of the connector support 19 can be horizontal, as shown in FIG. 6. In this case, the guide 24 is preferably mounted mobile along the axis Z so as to accompany the plugs during their transfer into the channels of the connector under the action of the fingers 41 through 43 of the insertion unit 39.

As shown in FIGS. 7 and 8, the machine can include an electronic control unit 72 connected to a terminal 73 for having data introduced by the machine operator, and a display terminal 74.

The electronic control unit 72 is connected to the activating elements previously described so as to control their functioning under the control of a software program according in particular to the data introduced by the operator and signals delivered by sensors integrated with the machine according to the normal rules concerning the displacement control of machine elements.

The functioning of the device is as follows with reference in particular to FIG. 6:

An operator places the connector 6 on the support 19 positioned at the right end of the guide 21 and pushes the support 19 towards the left along the guide. A contact (not shown) detects the presence of the support 19 in alignment under the guide 24 and initiates the plug insertion operation. The thruster 39 lowers the fingers 41 through 43 which push the plugs from the disk 26 towards the guide element 24. The guide 24 and the thruster 39 continue their downward movement together until the guide 24 touches the connector 6. The thruster 39 pushes the plugs from the guide 24 into the connector 6. The thruster 39 and the guide 24 then move back upwards. The operator pulls the support 19 to the right and removes the connector 6 equipped with the plugs. During movement of the thruster 39, the disk 26 is unable to rotate, but placement of new plugs on the disk can be made in a row of orifices situated along a straight line aligned with the finger 57 moving parallel to its guide axis 65 (FIG. 4A). The feed device 47, 49 and 57 through 60 for placing plugs on the disk moves along this axis 65. This displacement by the activating element 68, combined with rotation of the disk 26, makes it possible for the fingers 56 and 57 of the activating element 58 to reach a major portion of the surface of the disk. As previously described, the disk 26 has formed in two diametrically opposite zones two holes which constitute an image of those of the connector. The thruster 56 through 60 places the plugs in these holes according to a programmed configuration. The device of the invention can be equipped with two feed modules (as shown in FIGS. 4A and 4B) so as to respond to cases where two different plugs are used on the same connector.

In the case where the connectors are small and require few plugs, it is possible to place several connectors on a single support 19 and at the same time insert plugs in these connectors.

The launching of a new production (new configuration of connectors) is extremely simple. The configuration of the product to be produced is selected and then, if appropriate, the specific tools are placed on the machine: the feed unit(s), the disk, the thrusters, the connector support, and the guide element.

For programming the insertion of plugs in a new product (connector 6), the configuration of the new product is entered in a "product" data base of the control unit 72, as well as for each channel (8, 10 and 11) to be plugged the coordinates "X" and "Y" of the position of the axis (12, 14 and 15) of the channel and the identification of the plug (1, 28, 29 and 30) to be housed in the channel in question.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for placing a plug in a channel of a connector comprising:

a plug support receiving at least one plug adapted to be inserted in the channel of the connector, said plug support being at least one of a plug transfer disk, a small transfer plate and a rectangular plate, said plug support being pierced with at least two channels each capable of receiving the at least one plug;

a means for feeding the at least one plug to said plug support; and a transfer means for transferring the at least one plug from said plug support to the channel.

2. The device according to claim 1 wherein said plug support is mobile and has at least two orifices formed therein, each of said orifices being sized to retain the at least one plug by frictional engagement with walls of said orifice.

3. The device according to claim 2 wherein said orifices extend through said plug support and open onto two opposing faces of said plug support.

4. The device according to claim 1 including:

a connector support supporting the connector;

a plug guide element adjacent the connector and being pierced with at least two channels;

a means for aligning at least one of said channels of said plug guide element with the channel of the connector; and insertion fingers on said transfer means moveable along axes of said channels of said plug guide for transferring the at least one plug from said plug support through said plug guide element to the channel of the connector.

5. A device for inserting at least one sealing plug in an unused channel of a connector, the connector having a face onto which the channel is open, comprising:

a means for pushing the at least one plug into the channel; and a guide means for guiding the at least one plug during movement by said means for pushing, said guide means having a face shaped to correspond to a shape of the face of the connector.

6. The device according to claim 5 including a plug support for receiving the at least one plug and wherein said means for pushing pushes the at least one plug from said plug support and through said guide means.

7. The device according to claim 6 wherein said plug support is mobile and has at least two orifices formed therethrough, each of said orifices being sized to retain the at least one plug by frictional engagement with walls of said orifice.

8. A method for introducing plugs into channels of a connector placed on a connector support, the plugs being stored in a container, comprising the steps of:

a. extracting the plugs from the container and placing the plugs in a row;

b. transferring at least one of the plugs from the row to a mobile plug transfer support;

c. moving the mobile plug transfer support to align the at least one plug with a channel to be sealed in a connector;

d. inserting an insertion guide between the mobile plug transfer support and the connector; and e. extracting the at least one plug from the mobile plug transfer support and inserting the at least one plug in the channel of the connector by guiding the at least one plug with the insertion guide.

9. The method according to claim 8 including performing said steps b. through e. simultaneously for a first plurality of the plugs to be inserted in corresponding channels of the connector.

10. The method according to claim 9 including performing said step b. for a second plurality of the plugs intended for insertion in another connector while performing at least one of said steps d. and e. for the first plurality of the plugs.

11. The method according to claim 8 including performing said steps a. through e. at a rate equal to at least 1000 of the plugs inserted per hour.

12. The method according to claim 8 including forming the plugs each with at least one ductile annular rib.

13. A sealed electric connector having at least one channel sealed by the at least one plug in accordance with the method of claim 8.

14. A device for placing a plug in an unused channel of an electrical connector comprising:

a plug support receiving and releasably retaining at least a first plug adapted to be inserted in the channel of the connector and at least a second plug adapted to be inserted in a channel of another connector;

a means for feeding the first plug and the second plug to said plug support in sequence; and a transfer means for transferring the first plug from said plug support to the channel while aid means for feeding feeds the second plug to said plug support.

15. The device according to claim 14 wherein said plug support is mobile and has a plurality of orifices formed therein, each of said orifices being sized to retain one of the first plug and the second plug by frictional engagement with walls of said orifice.

16. The device according to claim 15 wherein said orifices extend through said plug support and open onto two opposing faces of said plug support.

17. The device according to claim 14 wherein said plug support is at least one of a plug transfer disk, a small transfer plate and a rectangular plate, said plug support being pierced with at least two channels each capable of receiving one of the first plug and the second plug.

* * * * *